US008303344B2

(12) United States Patent
Xiao et al.

(10) Patent No.: US 8,303,344 B2
(45) Date of Patent: Nov. 6, 2012

(54) ELECTRICAL CONNECTOR WITH IMPROVED NOTCH STRUCTURE TO SEPARATE LARGE AND SMALL RECEIVING CAVITIES ARRANGED SIDE BY SIDE

(75) Inventors: Jian-Ping Xiao, Shenzhen (CN); Tsuneki Watanabe, Yokohama (JP)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/430,711

(22) Filed: Mar. 27, 2012

(65) Prior Publication Data

US 2012/0178295 A1 Jul. 12, 2012

Related U.S. Application Data

(63) Continuation of application No. 13/218,457, filed on Aug. 26, 2011, now Pat. No. 8,142,226, which is a continuation of application No. 12/611,120, filed on Nov. 3, 2009, now Pat. No. 8,011,960.

(30) Foreign Application Priority Data

Nov. 3, 2008 (CN) ..... 2008 2 0302632 U

(51) Int. Cl.
*H01R 13/648* (2006.01)

(52) U.S. Cl. ..... 439/607.56; 439/607.48; 439/607.24

(58) Field of Classification Search ..... 439/607.23–607.25, 607.41–607.52, 439/607.54, 607.55–607.57
See application file for complete search history.

(56) References Cited

U.S. PATENT DOCUMENTS

| | | | | |
|---|---|---|---|---|
| 6,210,216 | B1 * | 4/2001 | Tso-Chin et al. | 439/545 |
| 6,305,986 | B1 * | 10/2001 | Hwang | 439/607.44 |
| 6,383,024 | B1 * | 5/2002 | Wang et al. | 439/607.23 |
| 6,439,926 | B1 * | 8/2002 | Kuan | 439/607.4 |
| 6,722,924 | B1 * | 4/2004 | Zhou et al. | 439/607.23 |
| 6,736,677 | B1 * | 5/2004 | Lin et al. | 439/607.28 |
| 6,776,658 | B2 * | 8/2004 | Tang | 439/607.58 |
| 6,799,997 | B2 * | 10/2004 | Lin et al. | 439/607.51 |
| 6,846,200 | B1 * | 1/2005 | Hsu | 439/540.1 |
| 6,863,546 | B2 * | 3/2005 | Yang et al. | 439/79 |
| 6,939,177 | B2 | 9/2005 | Kato et al. | |
| 7,273,397 | B2 * | 9/2007 | Watanabe et al. | 439/607.27 |
| 7,422,465 | B2 * | 9/2008 | Watanabe et al. | 439/353 |
| 7,690,948 | B2 * | 4/2010 | Lung | 439/607.27 |
| 7,736,186 | B2 * | 6/2010 | Li et al. | 439/607.55 |
| 7,736,190 | B2 * | 6/2010 | Yuan et al. | 439/660 |
| 7,794,279 | B1 * | 9/2010 | Ye et al. | 439/607.54 |
| 7,845,965 | B2 * | 12/2010 | Ko | 439/352 |
| 7,850,477 | B2 * | 12/2010 | Koyama et al. | 439/358 |

(Continued)

*Primary Examiner* — Ross Gushi
(74) *Attorney, Agent, or Firm* — Wei Te Chung; Ming Chieh Chang

(57) ABSTRACT

An electrical connector (100) includes an insulative body (1) having a wide tongue (123) and a narrow tongue (121) split by a gap (124) therebetween. A metallic shell (32) includes a front pocket (320) defining a large receiving cavity (327) enclosing the wide tongue (123), a small receiving cavity (325) enclosing the narrow tongue (121), and a non-circumferentially enclosed notch structure (33) which protrudes into the gap (124) so as to form the large receiving cavity (327) and the small receiving cavity (325). Besides, the notch structure (33) defines a notch (330) opened to an exterior from a bottom side thereof. First and second sets of contacts (211, 212) are located in the wide tongue and the narrow tongue, respectively, and the first contacts (211) are compatible to version 2.0 Micro Universal Serial Bus.

20 Claims, 6 Drawing Sheets

U.S. PATENT DOCUMENTS

| | | | | |
|---|---|---|---|---|
| 8,011,960 | B2 * | 9/2011 | Xiao et al. | 439/607.56 |
| 8,142,226 | B2 * | 3/2012 | Xiao et al. | 439/607.56 |
| 2002/0048992 | A1 * | 4/2002 | Wang et al. | 439/607 |
| 2002/0064996 | A1 * | 5/2002 | Zheng et al. | 439/607 |
| 2003/0124909 | A1 * | 7/2003 | Zhu et al. | 439/608 |
| 2004/0127099 | A1 * | 7/2004 | Lin et al. | 439/610 |
| 2007/0149054 | A1 * | 6/2007 | Watanabe et al. | 439/607 |
| 2007/0155243 | A1 * | 7/2007 | Watanabe et al. | 439/610 |
| 2009/0017684 | A1 * | 1/2009 | Lin | 439/610 |
| 2009/0318026 | A1 * | 12/2009 | Yi et al. | 439/607.24 |
| 2009/0325417 | A1 * | 12/2009 | Ko | 439/350 |
| 2010/0062653 | A1 * | 3/2010 | Mao et al. | 439/660 |
| 2010/0112863 | A1 * | 5/2010 | Xiao et al. | 439/607.27 |
| 2010/0158449 | A1 * | 6/2010 | Yi | 385/75 |
| 2011/0263150 | A1 * | 10/2011 | Sasaki et al. | 439/345 |
| 2011/0312217 | A1 * | 12/2011 | Xiao et al. | 439/607.23 |

* cited by examiner

ELECTRICAL CONNECTOR WITH IMPROVED NOTCH STRUCTURE TO SEPARATE LARGE AND SMALL RECEIVING CAVITIES ARRANGED SIDE BY SIDE

This application is a continuation of U.S. patent application Ser. No. 13/218,457, filed Aug. 26, 2011, now U.S. Pat. No. 8,142,226, which is a continuation of U.S. patent application Ser. No. 12/611,120, filed Nov. 3, 2009, now U.S. Pat. No. 8,011,960. The content of each of the above-referenced U.S. patents is incorporated by reference herein in its entirety.

BACKGROUND OF THE INVENTION

1. Field of the Invention

The present invention relates to the art of electrical connectors, and more particularly to an electrical connector with improved notch structure so as to form a large receiving cavity and a small receiving cavity arranged side by side.

2. Description of Related Art

Recently, Personal Computers (PCs) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can be used to connect peripherals such as mouse devices, keyboards, PDAs, gamepads and joysticks, scanners, digital cameras, printers, external storages, networking components, etc. For many devices such as scanners and digital cameras, USB has become the standard connection solution. Further, with the trend of miniaturization, micro USB connectors have been popular. However, the conventional micro USB connectors can not meet higher and higher data transmission demand. As a result, a new kind of connector extending from the micro USB connector for high data transmitting efficiency is desired.

BRIEF SUMMARY OF THE INVENTION

The present invention provides electrical connector including an insulative body, a metallic shell enclosing the insulative body and first and second sets of contacts fixed to the insulative body. The insulative body includes a wide tongue and a narrow tongue side by side arranged with each other, and the wide tongue and the narrow tongue are split by a gap therebetween. The metallic shell includes a front pocket which defines a large receiving cavity enclosing the wide tongue, a small receiving cavity enclosing the narrow tongue, and a non-circumferentially enclosed notch structure between the large receiving cavity and the small receiving cavity. The notch structure protrudes at least partly into the gap so as to form the large receiving cavity and the small receiving cavity. Besides, the notch structure defines a notch opened to an exterior from a bottom side thereof. The first and the second sets of contacts are located in the wide tongue and the narrow tongue, respectively, and the first contacts are compatible to version 2.0 Micro Universal Serial Bus. The metallic shell includes a top wall, a first side wall extending downwardly from one side of the top wall, a second side wall extending downwardly from the other side of the top wall, a first bottom wall connected to the first side wall and a second bottom wall connected to the second side wall. The notch structure includes a first lateral wall connected to the first bottom wall and a second lateral wall connected to the second bottom wall. The larger receiving cavity defines a first horizontal central line, the small receiving cavity defines a second horizontal central line, and a top end of the notch structure protrudes upwardly beyond the first horizontal central line and the second horizontal central line.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
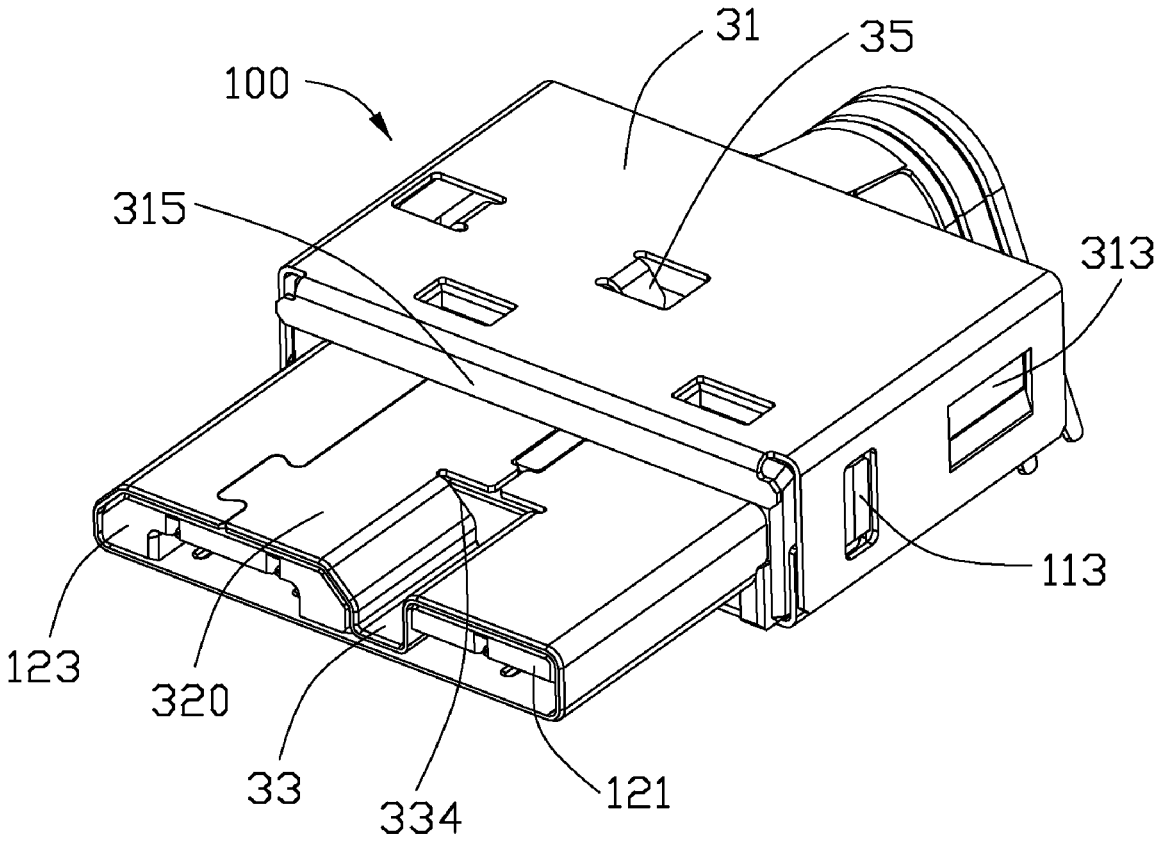
FIG. 1 is an assembled, perspective view of an electrical connector according to a preferred embodiment of the present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
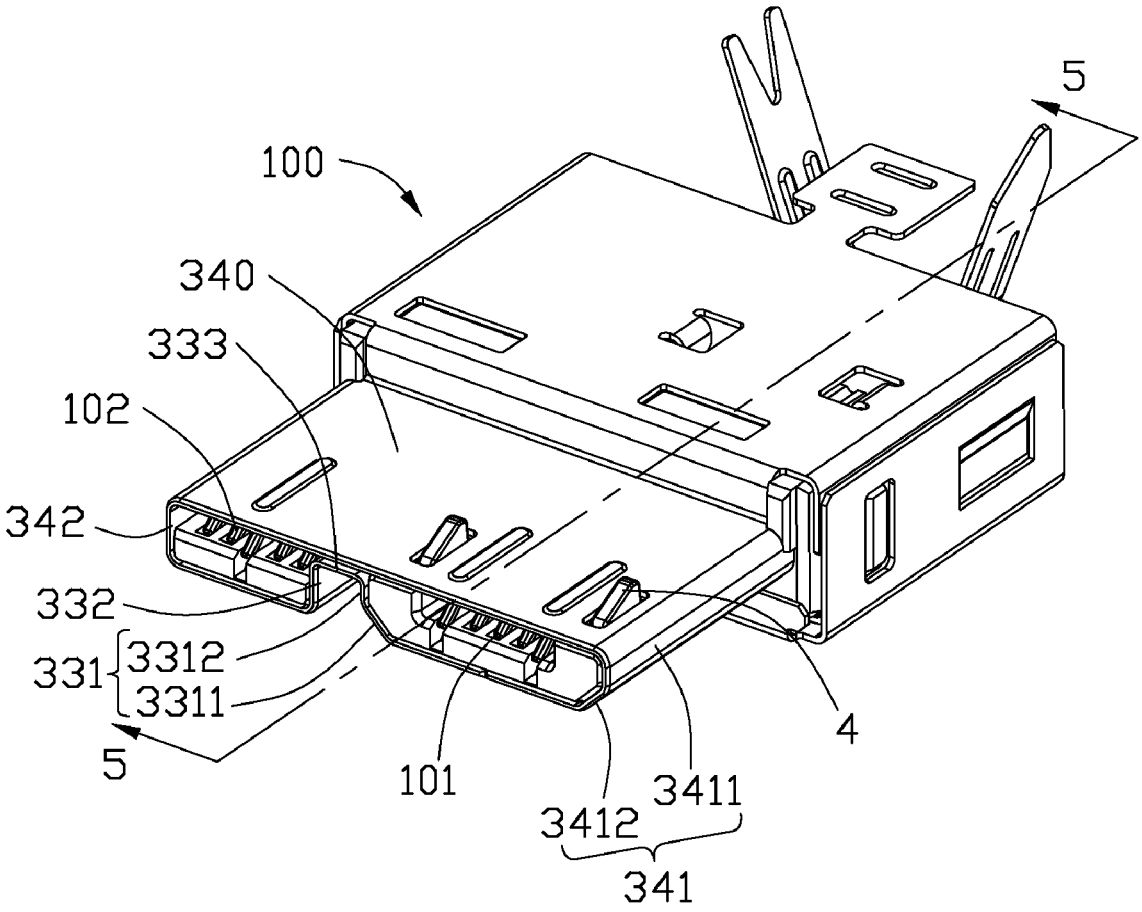
FIG. 2 is an assembled, perspective view of the electrical connector of FIG. 1, viewed from another aspect.

Referring to FIGS. 1 to 5, an electrical connector 100 includes an insulative body 1 with a plurality of contact terminals 2 held therein, a metallic shell 32 and a sub-shell 31 in cooperation with the metallic shell 32 to shield the insulative body 1. As shown in FIG. 2, from a front view thereof, the electrical connector 100 defines a first mating port 101 and a second mating port 102 side by side arranged with each other along a horizontal direction. According to the illustrated embodiment of the present invention, the first mating port 101 is regarded as a micro USB interface.

Figure 4:
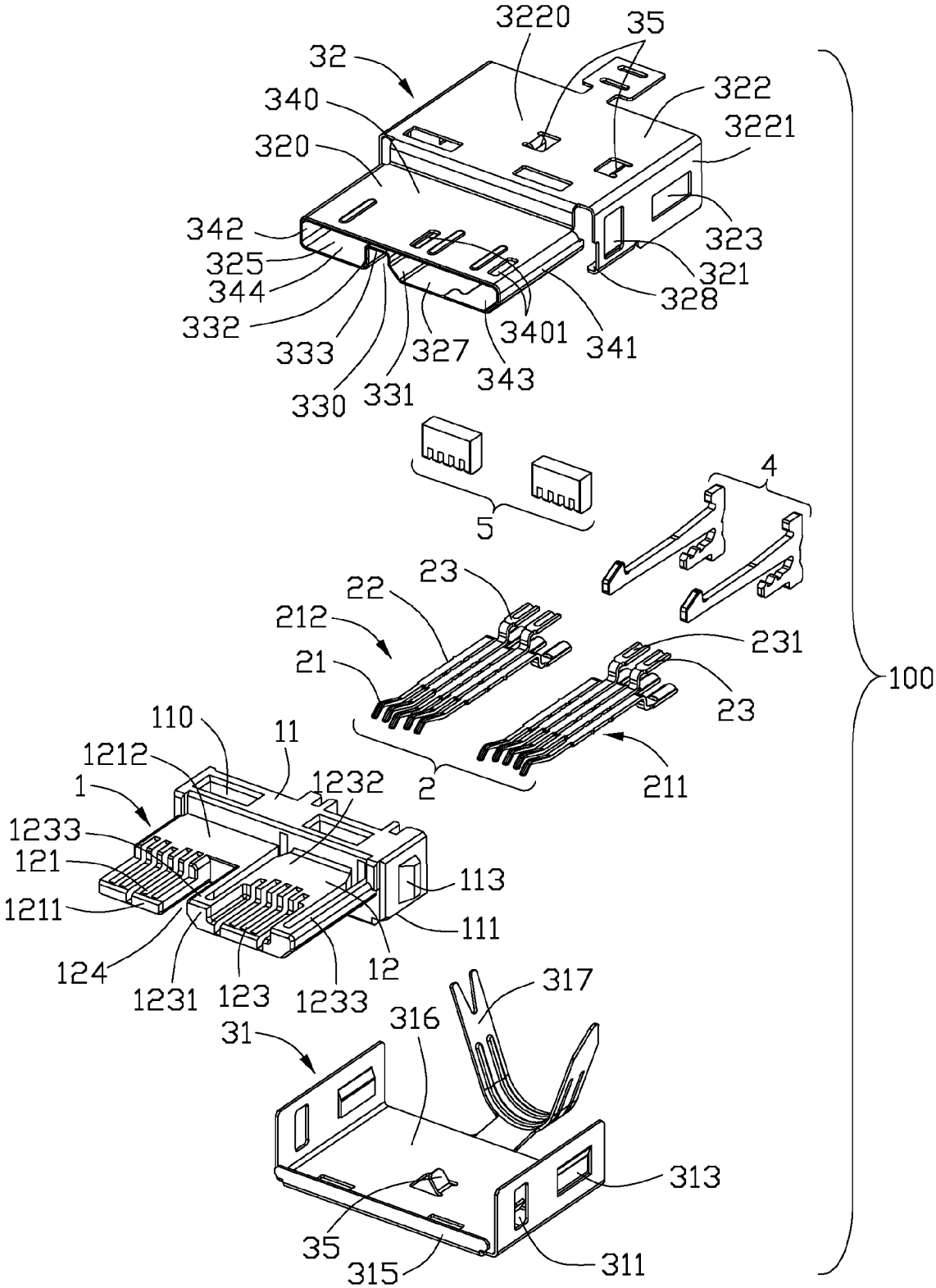
FIG. 4 is an exploded, perspective view of the electrical connector of FIG. 1, viewed from another aspect.

Referring to FIG. 4, the insulative body 1 includes a thick backward part 11 and a thin forward part 12 integrally extending forwardly beyond the backward part 11. The forward part 12 is split into a narrow tongue 121 and a wide tongue 123 side by side arranged with each other and disposed in a common plane. The narrow tongue 121 and the wide tongue 123 are spaced apart from each other by a gap 124 horizontally located therebetween through a front end of the forward part 12. Each of the narrow tongue 121 and the wide tongue 123 has an upper mating face. The backward part 11 includes a pair of side tabs 113 on opposite sidewalls for first slots 321 of the metallic shell 32 to be firstly engaged therewith, and then for second slots 311 of the sub-shells 31, located outside of the first slots 321 of the metallic shell 32, to be engaged therewith. Thus, the insulative body 1, the metallic shell 32 and the sub-shell 31 are assembled as a unit. Each of the side tabs 113 has upper and lower horizontal faces to restrict a movement of the metallic shell 32 relative to the sub-shell 31 along a vertical direction. Front portions 1231, 1211 of the wide tongue 123 and the narrow tongue 121 are laterally split from each other while rear portions 1232, 1212 of the wide tongue 123 and the narrow tongue 121 are united with each other for reinforcement. The narrow tongue 121 is flat shaped from a front view and the wide tongue 123 is U-shaped from the front view. The wide tongue 123 is thicker than the narrow tongue 123. The wide tongue 123 is equipped with a pair of raised platforms 1233 with a pair of latches 4 movable therein, respectively.

Figure 5:
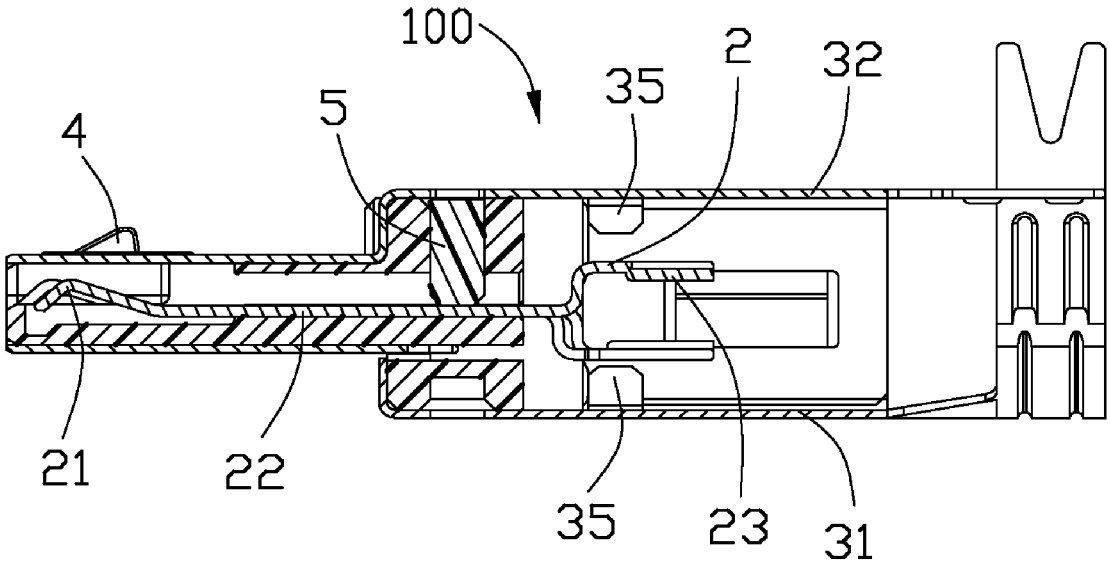
FIG. 5 is a cross sectional view of the electrical connector of FIG. 2, taken along line 5-5 thereof.
Figure 6:
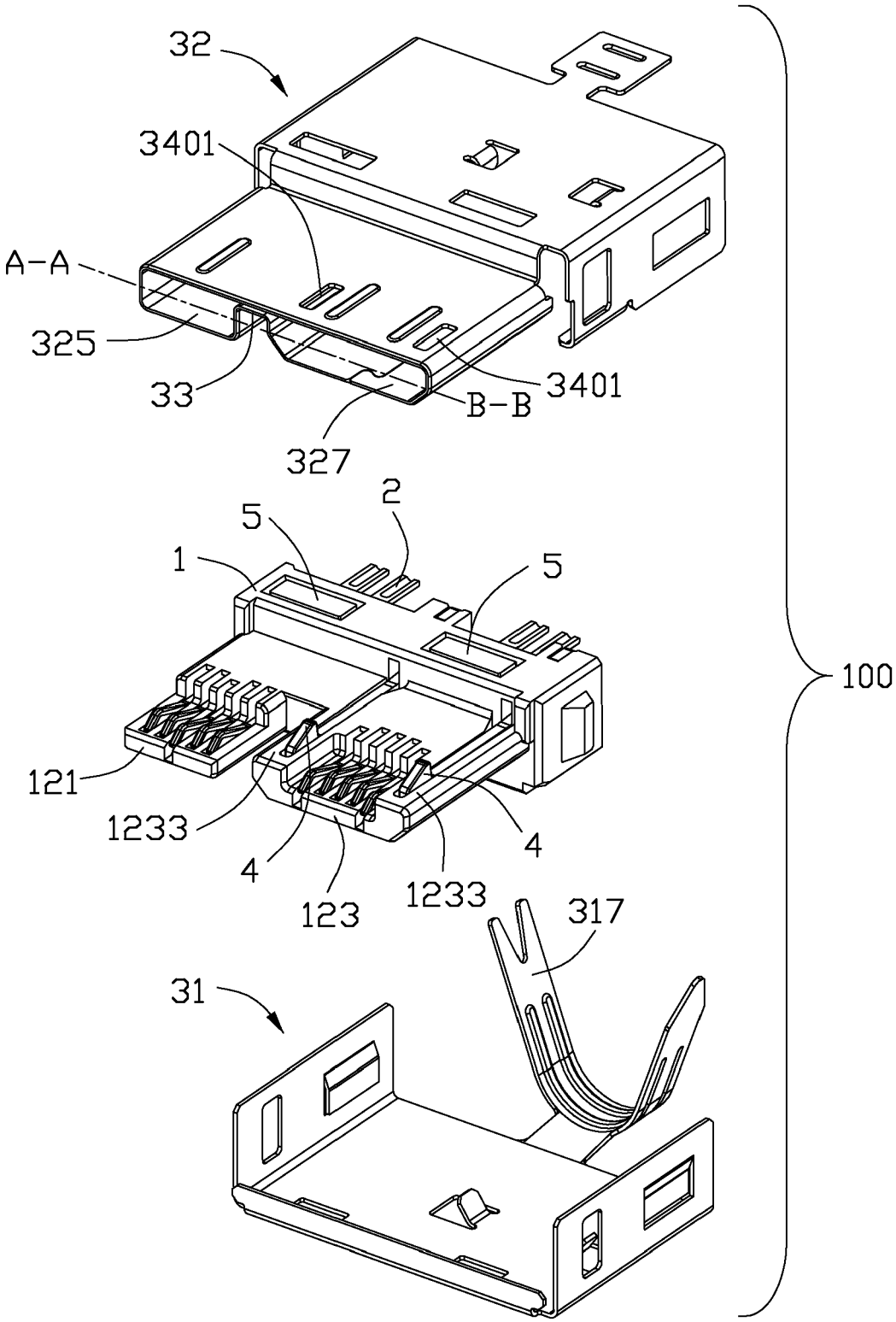
FIG. 6 is a partly-exploded, perspective view of the electrical connector of FIG. 3, viewed from another aspect.

The contact terminals 2 include first and second sets of contacts 211, 212 located in the wide tongue 123 and the narrow tongue 121, respectively. The first contacts 211 are compatible to version 2.0 Micro Universal Serial Bus. That is to say, the definition of the first contacts 211 for signal transmission is compatible to version 2.0 Micro Universal Serial Bus. Each contact terminal 2 includes a resilient contact portion 21 exposed upon the mating face of the narrow tongue 121 and the wide tongue 123, a mounting portion or a surface mounted leg 23 extending out of a back wall of the backward part 11, and a connecting portion 22 connecting the contact portion 21 and the mounted leg 23. Each surface mounted leg 23 includes a recessed section 231 for being easily soldered with cables (not shown). As shown in FIGS. 4 to 6, a pair of blocks 5 are provided to be inserted into corresponding openings 110 of the backward part 11 for pressing against the connecting portions 22 of the contact terminals 2.

The metallic shell 32, made of metal material, integrally includes a front pocket 320 and a back segment 322 backwardly extending from the front pocket 320. According to the illustrated embodiment of the present invention, the metallic shell 32 is of a unitary one piece for cost saving. The front pocket 320 essentially extends in a coplanar manner to cover the whole forward part 12 in a front-to-back direction disregarding the front portions 1231, 1211 or the rear portions 1232, 1212 of the wide tongue 123 and the narrow tongue 121. The back segment 322 essentially covers the backward part 11. The front pocket 320 defines a large receiving cavity 327 enclosing the wide tongue 123, a small receiving cavity 325 enclosing the narrow tongue 121, and a non-circumferentially enclosed notch structure 33 between the large receiving cavity 327 and the small receiving cavity 325. The notch structure 33 is formed by punching a wall of the metallic shell 32 towards an opposite wall. As shown in FIGS. 2 and 4, the notch structure 33 at least partly protrudes into the gap 124 along the vertical direction and forms the large receiving cavity 327 and the small receiving cavity 325. It is to be understood that the higher the notch structure 33 protrudes into the gap 124, the better robust shielding effectiveness can be achieved because the large receiving cavity 327 and the small receiving cavity 325 are much better separated. The notch structure 33 defines a notch 330 opened to an exterior from a bottom side thereof.

Referring to FIG. 4, the front pocket 320 includes a top wall 340, a first side wall 341 extending downwardly from one side of the top wall 340, a second side wall 342 extending downwardly from the other side of the top wall 340, a first bottom wall 343 connected to the first side wall 341 and a second bottom wall 344 connected to the second side wall 342. The first bottom wall 343 and the second bottom wall 344 are bridged by the notch structure 33 which includes a first lateral wall 331 connected to the first bottom wall 343, a second lateral wall 332 connected to the second bottom wall 344, and an upper horizontal wall 333 connecting the first lateral wall 331 and the second lateral wall 332. As shown in FIG. 6, the large receiving cavity 327 defines a first horizontal central line A-A, and the small receiving cavity 325 defines a second horizontal central line B-B in alignment with the first horizontal central line A-A. A top end, e.g. the upper horizontal wall 333, of the notch structure 33 protrudes upwardly beyond the first horizontal central line A-A and the second horizontal central line B-B. The upper horizontal wall 333 is parallel to and approaches the top wall 340. The top wall 340 defines a pair of slots 3401 through which the pair of latches 4 protrude. The large receiving cavity 327 is formed by the top wall 340, the first side wall 341, the first bottom wall 343 and the first lateral wall 331. The small receiving cavity 325 is formed by the top wall 340, the second side wall 342, the second bottom wall 344 and the second lateral wall 332. The first lateral wall 331 is substantially symmetrical to part of the first side wall 341, and the second lateral wall 332 is substantially symmetrical to part of the second side wall 342. The notch 330 is formed between the first lateral wall 331 and the second lateral wall 332.

Referring to FIG. 2, the first side wall 341 includes a first vertical portion 3411 and an inclined portion 3412 extending downwardly and inwardly from the first vertical portion 3411. The first lateral wall 331 includes an inclined section 3311 and a first vertical section 3312 extending upwardly from the inclined section 3311. An absolute value of the inclined section 3311 is the same as that of the inclined portion 3412. The first vertical section 3312 is parallel to the first vertical portion 3411. The second side wall 342 and the second lateral wall 332 extend along the vertical directions and are parallel to each other. The large and the small receiving cavities 327, 325 are substantially circumferentially enclosed. The wide tongue 123 attaches the first side wall 341, the first bottom wall 343 and the first lateral wall 331. The narrow tongue 121 attaches the second side wall 342, the second bottom wall 344 and the second lateral wall 332. The pair of raised platforms 1233 of the wide tongue 123 partly attach the top wall 340 while a top side of the narrow tongue 121 is separated from the top wall 340.

Figure 3:
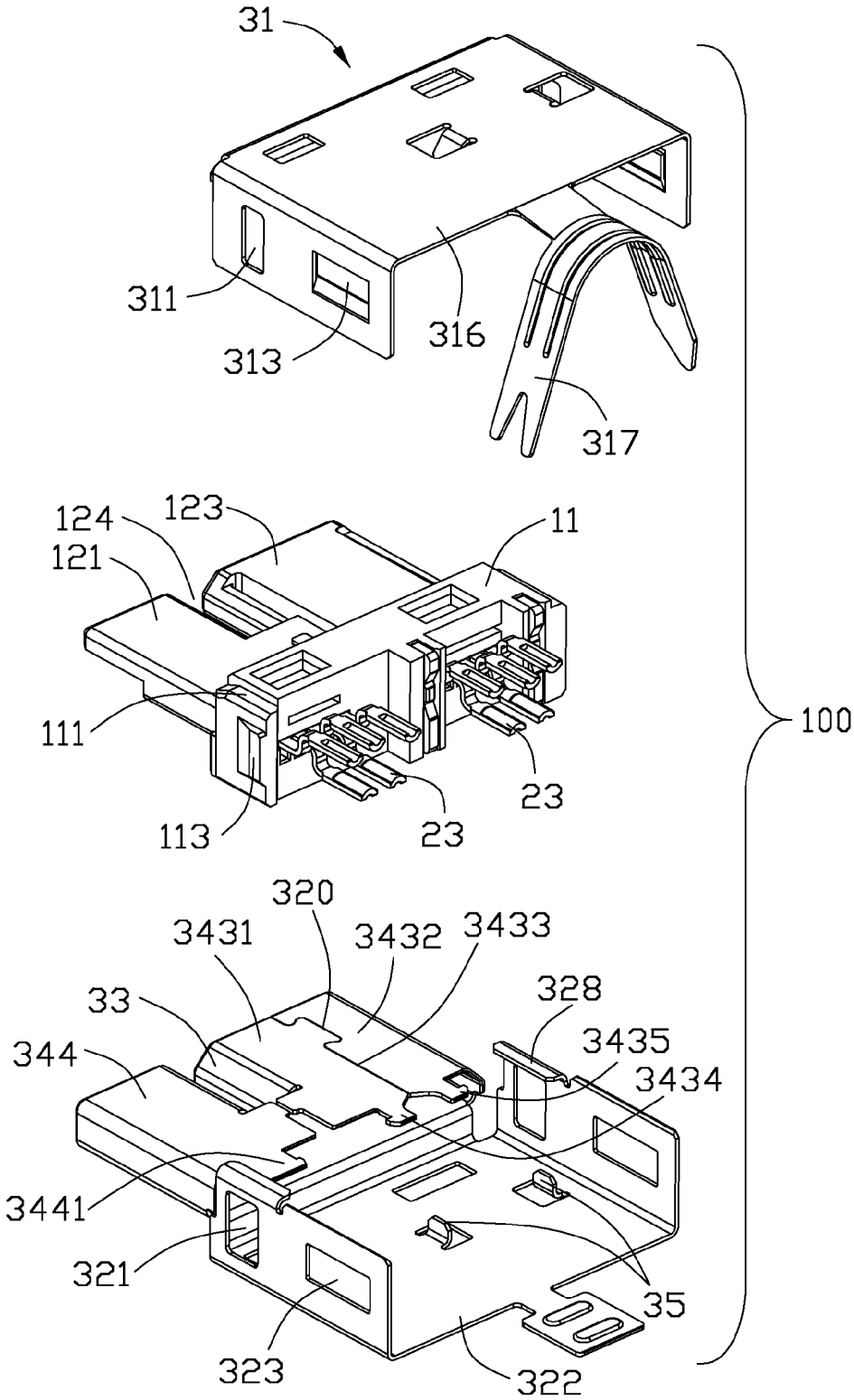
FIG. 3 is a partly-exploded, perspective view of the electrical connector of FIG. 1, showing a metallic shell and a sub-shell separated from an insulative body.

Referring to FIG. 3, the first bottom wall 343 includes a first part 3431 and a second part 3432 combined with each other by a joint 3433. The first part 3431 includes a first protrusion 3434 at one side of the joint 3433, and the second part includes a second protrusion 3435 at the other side of the joint 3433. The first and the second protrusions 3434, 3435 extend backwardly and are fixed in the insulative body 1 so that the configuration of the large receiving cavity 327 can be maintained. The second bottom wall 344 includes a third protrusion 3441 extending backwardly and fixed in the insulative body 1 so that the configuration of the small receiving cavity 325 can be maintained as well.

Referring to FIGS. 1 and 3, the notch structure 33 extends a length in the front-to-back direction shorter than that of the front pocket 320. The notch structure 33 backwardly terminates at a boundary of the front portions 1231, 1211 and the rear portions 1232, 1212 of the wide tongue 123 and the narrow tongue 121. The notch structure 33 includes a rear edge 334 resisting against the insulative body 1 in order to restrict a movement of the metallic shell 32 along the front-to-back direction.

Referring to FIGS. 3 and 4, the back segment 322 includes an upper piece 3220 covering an upper portion of the backward part 11 of the insulative body 1, a pair of side pieces 3221 bent downwardly from lateral edges of the upper piece 3220, and a pair of lower wings 328 extending inwardly from the respective side pieces 3221 and parallel to the upper piece 3220. The pair of lower wings 328 engage with a pair of stepped cutouts 111 of the insulative body 1 to assist the assembly of the insulative body 1 and the metallic shell 32.

The side pieces 3221 include a pair of first slots 321 each extending in the vertical direction and a pair of through holes 323 each extending in the horizontal direction.

The sub-shell 31, made of metal material, is assembled with the metallic shell 32 by a pair of second slots 311, located outside of the first slots 321 of the metallic shell 32, to cooperate with the first vertical slots 321 of the metallic shell 32 to commonly engage with the side tabs 113 of the backward part 11 so as to hold the metallic shell 32, the sub-shell 31 and the insulative body 1 in position along the vertical direction. The sub-shell 31 includes a pair of spring tabs 313 extending in the horizontal direction to resiliently engage with the through holes 323 to hold the metallic shell 32 and the sub-shell 31 in position along the horizontal direction. Thus, the metallic shell 32, the sub-shell 31 and the insulative body 1 are held in position by combination of the horizontal position and the vertical position. The sub-shell 31 includes a lower piece 316 covering a lower portion of the backward part 11 of the insulative body 1. Thus, the backward part 11 of the insulative body 1 is sandwiched by the cooperation of the back segment 322 of the metallic shell 32 and the sub-shell 31. Further, the sub-shell 31 includes a front edge section 315 extending toward the front pocket 320 to abut against the front pocket 320. As a result, when the discrete metallic shell 32 and the sub-shell 31 are assembled, the shielding effectiveness thereof can be improved. That is to say, the metallic shell 32 and the sub-shell 31 are assembled together to provide a robust shielding enclosure for the insulative body 1, where the contact terminals 2 are held therein.

According to the illustrated embodiment of the present invention, the upper piece 3220 of the metallic shell 32 and the lower piece 316 of the sub-shell 31 include a pair of projections 35 extending inside for abutting against the insulative body 1 so as to restrict a movement of the metallic shell 32 and/or the sub-shell 31 with respect to the insulative body 1 along a back-to-front direction. Besides, the sub-shell 31 includes a U-shaped clip 317 for regulating the cables. It is to be understood that the U-shaped clip 317 can be replaced to be formed on the metallic shell 32.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector comprising:

an insulative body comprising a wide tongue and a narrow tongue side by side arranged with each other, the wide tongue and the narrow tongue being split by a gap therebetween along a horizontal direction;

a metallic shell comprising a front pocket, the front pocket defining a large receiving cavity enclosing the wide tongue, a small receiving cavity enclosing the narrow tongue, and a non-circumferentially enclosed notch structure between the large receiving cavity and the small receiving cavity, the notch structure protruding at least partly into the gap along a vertical direction perpendicular to the horizontal direction so as to form the large receiving cavity and the small receiving cavity; and first and second sets of contacts located in the wide tongue and the narrow tongue, respectively, the first contacts being compatible to version 2.0 Micro Universal Serial Bus; wherein the front pocket comprises a top wall, a first side wall extending downwardly from one side of the top wall, a second side wall extending downwardly from the other side of the top wall, a first bottom wall connected to the first side wall and a second bottom wall connected to the second side wall, the notch structure comprising a first lateral wall connected to the first bottom wall and a second lateral wall connected to the second bottom wall, the notch structure defining a notch formed between the first lateral wall and the second lateral wall, and the notch being opened to an exterior from a bottom side thereof; and wherein the larger receiving cavity defines a first horizontal central line, the small receiving cavity defines a second horizontal central line, and a top end of the notch structure protrudes upwardly beyond the first horizontal central line and the second horizontal central line.

2. The electrical connector as claimed in claim 1, wherein the first lateral wall is substantially symmetrical to part of the first side wall, the second lateral wall is substantially symmetrical to part of the second side wall, and the first horizontal central line is in alignment with the second horizontal central line along the horizontal direction.

3. The electrical connector as claimed in claim 1, wherein the first side wall comprises a first vertical portion and an inclined portion extending downwardly and inwardly from the first vertical portion, the first lateral wall comprising an inclined section of which its slope in absolute value is the same as that of the inclined portion.

4. The electrical connector as claimed in claim 3, wherein the first lateral wall comprises a first vertical section extending upwardly from the inclined section under condition that the first vertical section is parallel to the first vertical portion; and wherein the second side wall and the second lateral wall extend along the vertical directions and are parallel to each other.

5. The electrical connector as claimed in claim 1, wherein the notch structure comprises an upper horizontal wall connecting the first lateral wall and the second lateral wall, the upper horizontal wall being parallel to and approaching the top wall.

6. The electrical connector as claimed in claim 1, wherein the narrow tongue is flat from a front view and the wide tongue is U-shaped from the front view, and the wide tongue is thicker than the narrow tongue; and wherein the wide tongue is equipped with a pair of raised platforms with a pair of latches movable therein, respectively, the top wall defining a pair of slots through which the pair of latches protrude.

7. The electrical connector as claimed in claim 6, wherein the large and the small receiving cavities are substantially circumferentially enclosed, the wide tongue attaching the first side wall, the first bottom wall and the first lateral wall, the narrow tongue attaching the second side wall, the second bottom wall and the second lateral wall, the pair of raised platforms of the wide tongue partly attaching the top wall while a top side of the narrow tongue being separated from the top wall.

8. The electrical connector as claimed in claim 1, wherein the notch structure extends a length in a front-to-back direction shorter than that of the front pocket, the notch structure comprising a rear edge resisting against the insulative body in order to restrict a movement of the metallic shell along the front-to-back direction.

9. The electrical connector as claimed in claim 1, wherein the insulative body comprises a thick backward part and a thin forward part extending beyond the backward part, the wide tongue and the narrow tongue being located at the forward part.

10. The electrical connector as claimed in claim 9, wherein the metallic shell comprises a back segment protruding backwardly from the front pocket under condition that the front pocket essentially fully encloses the whole forward part and the back segment essentially covers the backward part.

11. The electrical connector as claimed in claim 9, wherein front portions of the wide tongue and the narrow tongue are laterally split from each other while rear portions of the wide tongue and the narrow tongue are united with each other, and the notch structure backwardly terminates at a boundary of the front portions and the rear portions of the wide tongue and the narrow tongue.

12. The electrical connector as claimed in claim 10, further comprising a sub-shell cooperating with the metallic shell to get the backward part sandwiched between the back segment and the sub-shell.

13. The electrical connector as claimed in claim 12, wherein either the metallic shell or the sub-shell comprises at least one projection extending inside for abutting against the insulative body so as to restrict a movement of the metallic shell and/or the sub-shell with respect to the insulative body along a back-to-front direction.

14. The electrical connector as claimed in claim 12, wherein the backward part comprises at least one side tab formed on a lateral side thereof, the back segment comprising at least one vertical wall defining a first slot, the sub-shell defining a second slot in alignment with the first slot, the first and the second slots commonly receiving the side tab.

15. The electrical connector as claimed in claim 12, wherein the first and the second sets of contacts each comprise soldering portions to be soldered with cables, and either the sub-shell or the metallic shell comprises a U-shaped clip for regulating the cables.

16. The electrical connector as claimed in claim 1, wherein the first bottom wall comprises a first part and a second part combined with each other by a joint, the first part comprising a first protrusion at one side of the joint and the second part comprising a second protrusion at the other side of the joint, the first and the second protrusions being fixed in the insulative body.

17. The electrical connector as claimed in claim 1, wherein the metallic shell is of a unitary one piece.

18. An electrical connector assembly comprising:

an insulative housing including in a front-to-back direction a thick back part and a thin forward part extending forwardly from a front portion of the back part;

the forward part defining a large tongue and a small tongue side by side arranged with each other in a transverse direction perpendicular to said front-to-back direction under condition that front portions of said large tongue and said small tongue are laterally separated/split from each other while rear portions of said large tongue and said small tongue are united with each other;

first and second sets of contacts respectively located in the corresponding large tongue and the small tongue;

a metallic shell including a front pocket and a rear segment, said front pocket essentially fully enclosing the whole forward part and the rear segment essentially covering the back part; and the front pocket essentially defining juxtaposed circumferentially enclosed large and small receiving cavities with a non-circumferentially enclosed notch structure therebetween under condition that the large receiving cavity encloses the large tongue and the small receiving cavity encloses the small tongue; wherein the thick back part defines to a pair of upward openings in alignment with the corresponding large tongue and small tongue in the front-to-back direction, respectively, and a pair of blocks are respectively inserted downwardly, in a vertical direction perpendicular to both said front-to-back direction and said transverse direction, into the openings to press against connecting portions of the first and second sets of contacts, respectively.

19. An electrical connector assembly comprising:

an insulative housing including in a front-to-back direction a thick back part and a thin forward part extending forwardly from a front portion of the back part;

the forward part defining a large tongue and a small tongue side by side arranged with each other in a transverse direction perpendicular to said front-to-back direction under condition that front portions of said large tongue and said small tongue are laterally separated/split from each other while rear portions of said large tongue and said small tongue are united with each other;

first and second sets of contacts respectively located in the corresponding large tongue and the small tongue;

a metallic shell including a front pocket and a rear segment, said front pocket essentially fully enclosing the whole forward part and the rear segment essentially covering the back part; and the front pocket essentially defining juxtaposed circumferentially enclosed large and small receiving cavities with a non-circumferentially enclosed notch structure therebetween under condition that the large receiving cavity encloses the large tongue and the small receiving cavity encloses the small tongue; wherein the large tongue is equipped with a pair of latches on two sides thereof, the thick back part of the housing defines a pair of grooves and the rear segment of the shell defines a pair of projections, said pair o grooves and said pair of projections being aligned with the pair of latches in the front-to-back direction respectively.

20. The electrical connector assembly as claimed in claim 19, wherein each of the pair of projections are stamped from the rear segment with a corresponding opening aside.

* * * * *